US011035165B2

(12) United States Patent
McDonald, II et al.

(10) Patent No.: US 11,035,165 B2
(45) Date of Patent: Jun. 15, 2021

(54) KEYLESS ACCESS FOR COMMERCIAL VEHICLES

(71) Applicant: The Shyft Group, Inc., Charlotte, MI (US)

(72) Inventors: Ernest M. McDonald, II, Granger, IN (US); James M. Newcomer, Elkhart, IN (US); Michael Andrew Smith, Goshen, IN (US); Samuel Francis Colalillo, Jr., New Carlisle, IN (US); Shan Lentine, Warkarusa, IN (US); Marcia Ann Blevens, Watervliet, MI (US)

(73) Assignee: The Shyft Group, Inc., Charolotte, MI (US)

( * ) Notice: Subject to any disclaimer, the term of this patent is extended or adjusted under 35 U.S.C. 154(b) by 148 days.

(21) Appl. No.: 16/371,830

(22) Filed: Apr. 1, 2019

(65) Prior Publication Data

US 2019/0226260 A1 Jul. 25, 2019

Related U.S. Application Data

(63) Continuation of application No. 13/090,912, filed on Apr. 20, 2011, now Pat. No. 10,246,921.

(51) Int. Cl.

| | |
|---|---|
| ***E05F 1/16*** | (2006.01) |
| ***E05F 5/08*** | (2006.01) |
| ***G07C 9/00*** | (2020.01) |

(52) U.S. Cl.

CPC ..... *E05F 1/16* (2013.01); *E05F 5/08* (2013.01); *G07C 9/00309* (2013.01);

(Continued)

(58) Field of Classification Search

CPC . G06F 7/00; G06F 17/60; B60R 25/10; B60R 25/2018; G08B 29/00; G05B 19/00;

(Continued)

(56) References Cited

U.S. PATENT DOCUMENTS 3,671,964 A * 6/1972 Trochanowski ..... H04K 3/822 342/20

3,840,103 A * 10/1974 Willis ..... D06F 95/00 194/210

(Continued)

OTHER PUBLICATIONS

"FedEx Ground P-700, P-1000 & P-1200 Keyless Entry & Keyless Start Diagnostics Manual", part No. 43004527, pp. 1-24 plus cover page for a total of 25 pages, published Oct. 2002, and revised thru' Apr. 30, 2003. Examiner notes that this 25-page publication was attached as an NPL by Applicant on Jul. 1, 2019.*

(Continued)

*Primary Examiner* — Alexander G Kalinowski
*Assistant Examiner* — Sanjeev Malhotra
(74) *Attorney, Agent, or Firm* — Barnes & Thornburg LLP

(57) ABSTRACT

A commercial vehicle used for parcel delivery is installed with a control module. The control module communicates wirelessly with a transmitter to give control to the vehicle operator. The vehicle operator can access the vehicle's cargo compartment through the bulkhead door and/or the rear door solely by using the transmitter as opposed to manually actuating the door latch. A door actuator is added to the bulkhead door such that when the bulkhead door is wirelessly actuated the door opens without operator assistance, and the process of the door opening does not damage the vehicle. Additionally, the vehicle operator can initiate the control module to allow a push-button start and stop of the vehicle's ignition system. Such elements contribute to time savings and cost savings for parcel delivery operators.

14 Claims, 7 Drawing Sheets

(52) U.S. Cl.
CPC ... *E05Y 2201/408* (2013.01); *E05Y 2201/474* (2013.01); *E05Y 2201/488* (2013.01); *E05Y 2800/22* (2013.01); *E05Y 2900/516* (2013.01); *E05Y 2900/531* (2013.01); *E05Y 2900/532* (2013.01); *G07C 2009/00507* (2013.01)

(58) Field of Classification Search
CPC ... B60P 7/02; F02K 3/02; B64C 25/10; E05C 19/00; E05C 3/16; E05C 3/12; E05F 15/20; E05F 15/04; G05D 7/06; E06B 3/38; E05B 65/06; E05B 51/02; A01C 7/06; A01C 15/00; A01C 3/06; E01C 19/20; E21B 47/00; B62D 59/04; B62D 61/10; B62D 23/005; B62D 31/025; B60K 6/00; B60K 17/00; B60K 1/00; F24F 7/02; G07F 11/58; G07D 9/04; G01S 3/02; B60G 2200/44; B60G 2202/152; B60G 2206/0114; B60B 2900/131; B60B 2900/311; B60L 15/20; B63B 19/12; G07C 2009/00261; G07C 2209/64; G07C 9/00182; G07C 9/00309; G07C 9/00674; H03K 17/962; H03K 17/97; H03K 2017/9713
USPC ..... 700/282; 340/5.6, 5.64, 426.1, 426.36; 296/105; 244/102 A; 292/201, 302; 60/226.2; 239/650, 672; 235/375; 236/49.5; 166/254.2; 180/23; 194/210; 377/7; 342/20, 387; 134/5; 301/126; 297/463.2; 343/906
See application file for complete search history.

(56) References Cited

U.S. PATENT DOCUMENTS

| | | | | |
|---|---|---|---|---|
| 3,901,366 | A * | 8/1975 | Schuller | G07F 7/02 194/210 |
| 4,210,277 | A * | 7/1980 | Kolt | F24F 11/76 236/49.5 |
| 4,746,319 | A * | 5/1988 | Zwieg | G07D 9/04 377/7 |
| 6,179,055 | B1 * | 1/2001 | Sallwasser | E21B 23/14 166/254.2 |
| 6,611,232 | B1 * | 8/2003 | Wunderlich | E05B 19/0005 342/387 |
| 6,626,357 | B1 * | 9/2003 | Ross | E05G 7/001 235/375 |
| 7,967,347 | B1 * | 6/2011 | Johnson | E05B 83/12 292/201 |
| 10,246,921 | B2 | 4/2019 | McDonald, II et al. | |
| 2001/0015213 | A1 * | 8/2001 | Clarke | F16L 55/24 134/5 |
| 2004/0075542 | A1 * | 4/2004 | Glasscock | G07C 9/00944 340/426.36 |
| 2004/0256502 | A1 * | 12/2004 | Niemela | E01C 19/203 239/650 |
| 2006/0237242 | A1 * | 10/2006 | Burke | B62D 23/005 180/23 |
| 2006/0255189 | A1 * | 11/2006 | Niemela | E01C 19/20 239/672 |
| 2007/0035153 | A1 * | 2/2007 | Henning | B60J 7/102 296/105 |
| 2007/0234707 | A1 * | 10/2007 | Beardsley | F02K 1/72 60/226.2 |
| 2008/0143174 | A1 * | 6/2008 | Burkett | F16C 3/02 301/126 |
| 2008/0265651 | A1 * | 10/2008 | Helmer | A47C 31/11 297/463.2 |
| 2009/0058759 | A1 * | 3/2009 | Morikawa | H01Q 1/38 343/906 |
| 2009/0108131 | A1 * | 4/2009 | Lavigne | B64C 25/12 244/102 A |
| 2010/0052849 | A1 * | 3/2010 | Steegmann | B60R 25/2027 340/5.64 |
| 2010/0264676 | A1 * | 10/2010 | Sternberger | B64C 13/00 292/302 |
| 2010/0277273 | A1 * | 11/2010 | Miller | B60R 25/2018 340/5.6 |
| 2010/0321173 | A1 * | 12/2010 | Magner | G07C 9/00182 340/426.1 |
| 2012/0072034 | A1 * | 3/2012 | Cathcart | B63B 19/12 700/282 |

OTHER PUBLICATIONS

Navistar, eStar Driver Instructions, pp. 1-10, Nov. 15, 2010, www.estar-ev.com/assets/pdf/eStar-Driver-Instructions.pdf.
TouchTronics, Inc., Electronic Keys, p. 1, Sep. 23, 2008.
TouchTronics, Inc., Hands Free LatchMatic, pp. 1-2, Feb. 25, 2009.
TouchTronics, Inc., Keyless Entry RFID Radio Frequency ID, pp. 1-2, Jun. 19, 2008.
TouchTronics, Inc., Keyless Start RFID Radio Frequency ID, pp. 1-2, Jun. 17, 2008.
TouchTronics, Inc., Bolt QE Quick Exist Door Release System, pp. 1-2, Jun. 10, 2010.
TouchTronics, Inc.,Package Delivery Truck Service Manual Keyless Entry and Keyless Start, pp. 1-2, Feb. 25, 2009.
Grumman Olson Industries Inc., FedEx Ground P-700, P-1000 & P-1200 Keyless Entry & Keyless Start Diagnostics Manual, pp. 1-24, Oct. 2002.
TouchTronics, Inc.. & Morgan Olson, LLC, FedEx Ground P-1200, Keyless Entry & Keyless Start Diagnostics Manual, pp. 1-16, Feb. 28, 2008.
FedEx Ground P-700, P-1000 and P-1200 Keyless Entry & Keyless Start Diagnostics Manual by Grumman Olson Industries Inc., 25 pages, Oct. 2002.
UAS Programming Guide, Utilimaster Access System; known prior to Apr. 20, 2011; 1 page; Utilimaster Corporation, Wakarusa, Indiana, USA.
Utilimaster Access System Operator's Guide; known prior to Apr. 20, 2011; 1 page; Utilimaster Corporation, Wakarusa, Indiana, USA.
Utilimaster Access System Service Manual; know prior to Apr. 20, 2011; pp. 1-24; Utilimaster Corporation, Wakarusa, Indiana, USA.

* cited by examiner

KEYLESS ACCESS FOR COMMERCIAL VEHICLES

CROSS-REFERENCE TO RELATED PATENT APPLICATION

This patent application is a continuation of U.S. patent application Ser. No. 13/090,912, filed Apr. 20, 2011, which is now allowed, the entire teachings and disclosure of which are incorporated herein by reference thereto.

FIELD OF THE INVENTION

This invention generally relates to commercial vehicles, and more particularly to efficient operation of commercial vehicles for parcel delivery.

BACKGROUND OF THE INVENTION

Commercial vehicles, such as parcel delivery vans, must have a long operational life, a low cost of ownership, and be safe work environments for the driver and handling personnel. The average commercial vehicle must be designed not only to withstand the wear and tear of making hundreds of stops every day, but also operate as efficiently as possible so to limit delivery time and provide the maximum value to the vehicle owner.

A typical commercial vehicle for parcel delivery has two main compartments. The first compartment is the cab compartment where the driver and handling personnel sit while the vehicle is driven from stop to stop. The second compartment is the cargo compartment. Access to the cargo compartment is achieved from two locations. The first location is from the rear of the vehicle via a roll-up or rear-swing door. The second location is the bulkhead door, which provides access to the cargo compartment via the cab compartment of the commercial vehicle.

The vehicle operators have a choice as to which cargo compartment access method they use when removing parcels. Typically, for larger parcels the rear access door is used because the rear door is larger than the bulkhead door. For smaller packages the vehicle operator(s) typically accesses the cargo compartment through the bulkhead door because it is more efficient for the operator to enter the cargo compartment directly from the cab of the vehicle as opposed to walking around to the rear of the truck for every stop.

Additionally, the vehicle operator has the choice of leaving the engine running once they arrive at the scheduled delivery location or shutting the engine off. Either choice is not ideal because if the operator leaves the engine running the vehicle will unnecessarily consume fuel and if they turn the engine off it will take several seconds to retrieve the key and restart the engine.

Because commercial vehicles used for parcel delivery will generally make hundreds of stops every day, and at each of those stops the operator will have to both shut the engine off and enter and exit the cargo compartment in order to obtain the parcel, efficient operation of the vehicle and efficient motion of the operator is extremely important. Accessing the cargo compartment of the vehicle efficiently and starting and stopping the vehicle engine efficiently saves delivery time, prevents unnecessary wear and tear on the vehicle, limits fuel consumption, and limits the potential for the operator to be injured by the repetitive nature of parcel delivery.

Typically, operation of a commercial vehicle used for parcel delivery entails the following processes. First, the operator must manually start the vehicle. Next the operator drives the vehicle to a scheduled delivery location. At the delivery location, the operator then must bring the vehicle to a stop, manually unlock the bulkhead door, manually open the bulkhead door, obtain the parcel, manually close the bulkhead door, deliver the parcel to the desired location, and finally restart the vehicle for the next delivery. A similar process is undertaken if the operator needs to use the rear door to access the cargo compartment as well. Additionally, the operator will pickup parcels at delivery locations. When parcels are collected, the operator will approach the vehicle with the parcel, manually unlock the bulkhead door, manually open the bulkhead door, deposit the parcel in the cargo compartment, and manually close the bulkhead door.

The delivery process described above presents several problems. The process of manually starting and stopping the vehicle, and unlocking, opening, and then closing the bulkhead door takes several seconds during each delivery and consumes fuel needlessly. Considering that the typical commercial vehicle used for parcel delivery makes hundreds of stops every day the additional time and fuel consumed at each delivery can be significant when viewed in the aggregate. Additionally, the repetitive motion of manually opening and closing the bulkhead door hundreds of times every day will cause damage to the vehicle and potentially harm the operator. Harm to the operator can come from the additional movement needed to unlock, open, and then close the door hundreds of times every day, and damage to the vehicle can come from the bulkhead door slamming open every time the cargo compartment is accessed.

In view of the above, there is a need for a cost efficient solution for operating a commercial vehicle that reduces the time and fuel consumed at each delivery and the potential harm to the vehicle and its operator. Embodiments of the invention provide such a solution for commercial vehicles. These and other advantages of the invention, as well as additional inventive features, will be apparent from the description of the invention provided herein.

BRIEF SUMMARY OF THE INVENTION

In view of the above, embodiments of the present invention provide new and improved commercial vehicle operation that overcome the problems existing in the art. More particularly, embodiments of the present invention provide new and improved operation of commercial vehicles for parcel delivery that overcome problems existing in the art. Still more particularly, embodiments of the present invention provide a new and improved way to control the ignition of the commercial vehicle and/or access the cargo compartment in a way that both minimizes damage to the vehicle, saves operator time, and reduces the likelihood of repetitive motion injury.

In one embodiment a control module is coupled to one or more of a commercial vehicle's ignition system, bulkhead door, and rear door. The control module controls these separate systems at the command of a vehicle operator communicating with the control module wirelessly through a transmitter.

Time is more efficiently managed, over the prior art, because movement is minimized in regard to starting and stopping the vehicle engine, opening the bulkhead door, and opening the rear door. Minimizing operator movement also has the added benefit of limiting the type of repetitive motion that can cause injuries to the operator over time.

Further, fuel consumed by leaving the engine running while at a delivery stop is minimized because the solution provides a quick and efficient way to turn the ignition off and on.

Finally, damage caused by the bulkhead door slamming opening is minimized. Damage is minimized because the door self actuates and has a dampening mechanism that keeps the door from slamming open and causing damage over time.

Additionally, in an embodiment of the present invention a lock box is attached to the vehicle. The lock box is securely closed and can only be opened by an individual with a key. Or if the box is locked via a combination lock only a person with the combination can unlock the box. The box is configured to hold a spare transmitter and/or an extra key to the commercial vehicle. The extra transmitter and/or key are to replace originals if lost or damaged.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
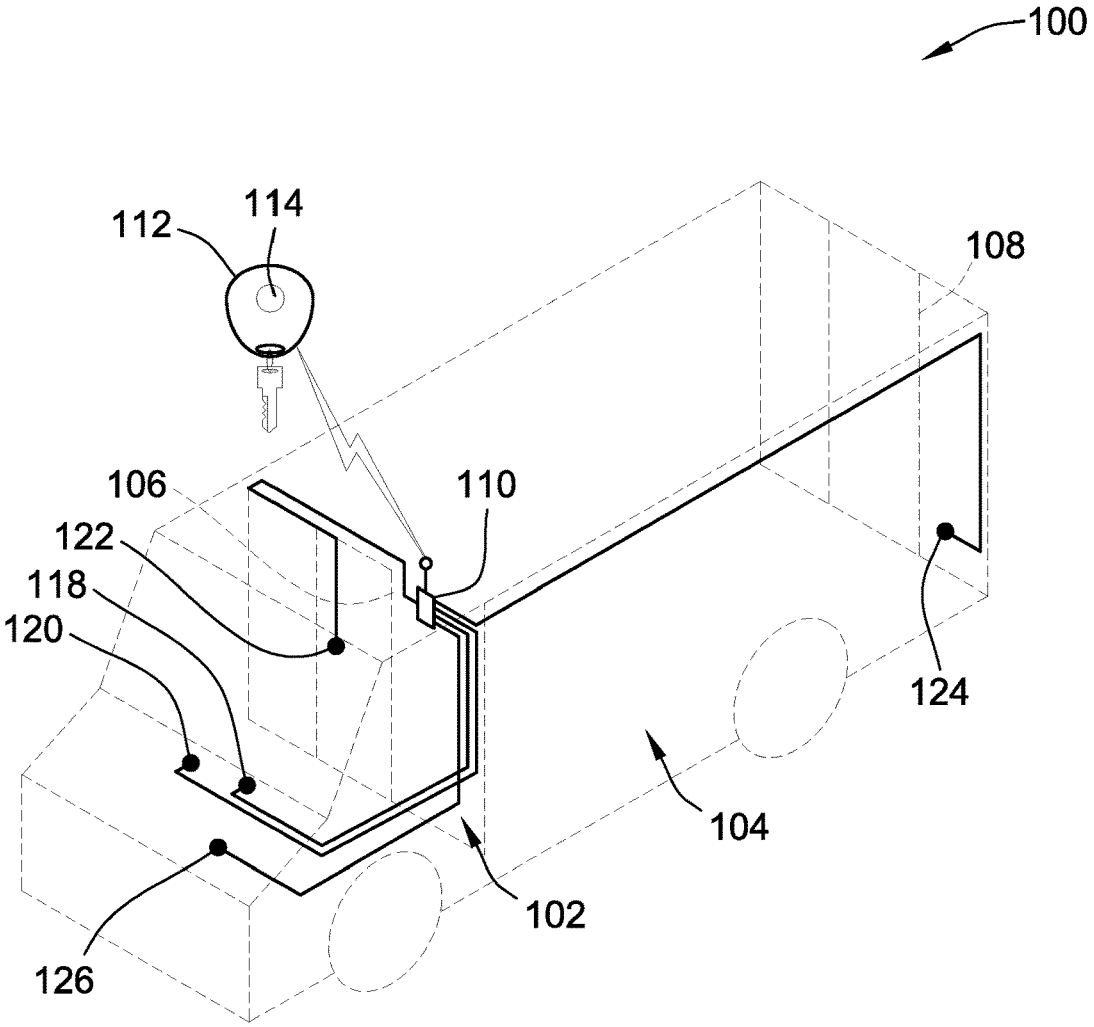
FIG. 1 is an illustration of a commercial vehicle with an embodiment of the present invention installed in the vehicle, including a transmitter.

Turning now to the drawings, there is illustrated in FIG. 1 a commercial vehicle 100 installed with a particular embodiment of the present invention. It should be noted, however, that while the following description will describe various embodiments and aspects of the various embodiments of the present invention configured for a commercial vehicle, the scope of the present invention is not so limited. Indeed, many of the aspects of the present invention may find applicability in other applications, in other commercial vehicles other than ones used strictly for parcel delivery. As such, the following description should be taken by way of example and not by way of limitation.

As may be seen from the embodiment illustrated in FIG. 1, the commercial vehicle 100 has two main compartments. The first compartment is the cab compartment 102. The cab compartment 102 is where the vehicle operation personnel sit while the commercial vehicle 100 is in use. The second compartment is the cargo compartment 104. Access to the cargo compartment 104 is achieved through two separate entry ways. The first method of access is through the rear door 108. The second method of access is through the bulkhead door 106.

In this particular embodiment of the invention, starting and stopping the commercial vehicle 100 and access to the cargo compartment 104 is optionally controlled through a transmitter 112 wirelessly communicating with a control module 110. As can be seen from FIG. 1 the control module 110 is installed in the commercial vehicle 100 and is communicatively coupled to several systems of the commercial vehicle 100.

Specifically, the control module 110 is coupled to the commercial vehicle power supply 126, the vehicle ignition 118, a keyless ignition control module 120, a solenoid latch 122 for the bulkhead door 106, and a solenoid latch 124 for the rear door 108. The vehicle operator can operate the control module 110 by using the transmitter 112 in the vicinity of the commercial vehicle 100.

The transmitter 112 enables wireless control of any one or more of the commercial vehicle's ignition 118, bulkhead door 106, and/or rear door 108. The transmitter 112 in one embodiment will enable the engine to start or stop via a start/stop ignition control module 120 installed in the commercial vehicle 100. Also, the bulkhead door 106 can be opened automatically without the need to self-actuate the solenoid latch 122. Finally, the rear door 108 can be opened automatically without the need to self-actuate the solenoid latch 124.

It should be noted that while this particular embodiment of the present invention discloses operating the vehicle start/stop function and access to the cargo compartment wirelessly, manual overrides of the wireless system may still function. A traditional key that allows an operator to start and stop the commercial vehicle 100 and gives access to the cargo compartment through both the bulkhead door 106 and the rear door 108 may be employed in conjunction with an embodiment of the present invention.

Figure 2:
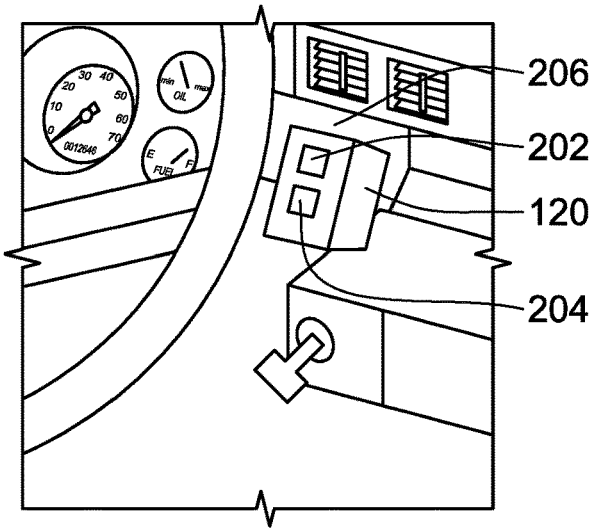
FIG. 2 is an illustration of the ignition switch of an embodiment of the present invention.

Turning now to FIG. 2, the ignition control module 120 is shown in more detail. The ignition control module 120 is installed in the dash 206 of commercial vehicle 100 in order to provide easy access to the vehicle's operator. The commercial vehicle ignition 118 is controlled by the start button 202 and the stop button 204.

In one embodiment the ignition control module 120 only operates in conjunction with transmitter 112 (see FIG. 1). Specifically, to start the commercial vehicle 100 an initiation signal must be sent from the transmitter 112 to the control module 110. The initiation signal is sent when the operator presses button 114 on the transmitter 112 within the vicinity of commercial vehicle 100. This readies the ignition control module 120. Now the operator needs only to press the start button 202 of ignition control module 120 shown in FIG. 2 once to start the commercial vehicle 100. To stop the commercial vehicle 100 the operator only needs to press the stop button 204 of the ignition control module 120.

Additionally, the bulkhead door 106 may be opened automatically upon stopping the engine of commercial vehicle 100. When the operator wants to stop the engine of the commercial vehicle 100 he depresses the stop button 204, and the commercial vehicle 100 shuts down. When the commercial vehicle 100 shuts down the operator may open the bulkhead door automatically by pressing the stop button 204 one additional time. The operator must perform the above sequence within a predetermined time period subsequent to shutting the commercial vehicle 100 down in order to enable this feature. When that time period expires control module 110 (from FIG. 1) resets the system to prevent unauthorized access to the cargo compartment.

The ignition control module 120 of the illustrated embodiment is not meant to entirely replace the traditional ignition 118, but rather only to supplement it. The traditional ignition 118 will still start and stop the commercial vehicle 100. The ignition control module 120, however, allows for a quicker starting and stopping process. In other embodiments, the ignition control module 120 may replace the traditional ignition.

Figure 3:
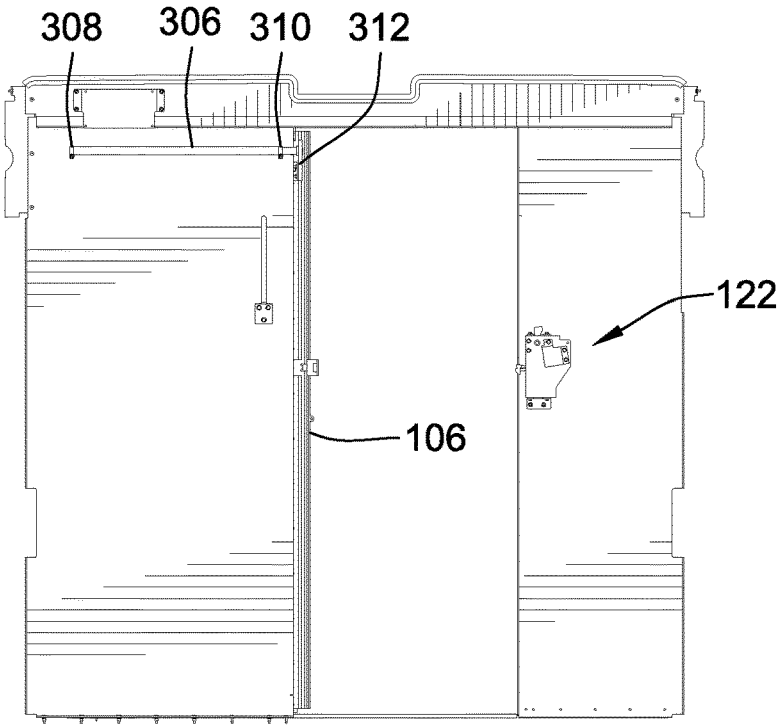
FIG. 3 is an illustration of the bulkhead door as viewed from the cargo compartment of the vehicle.
Figure 3A:
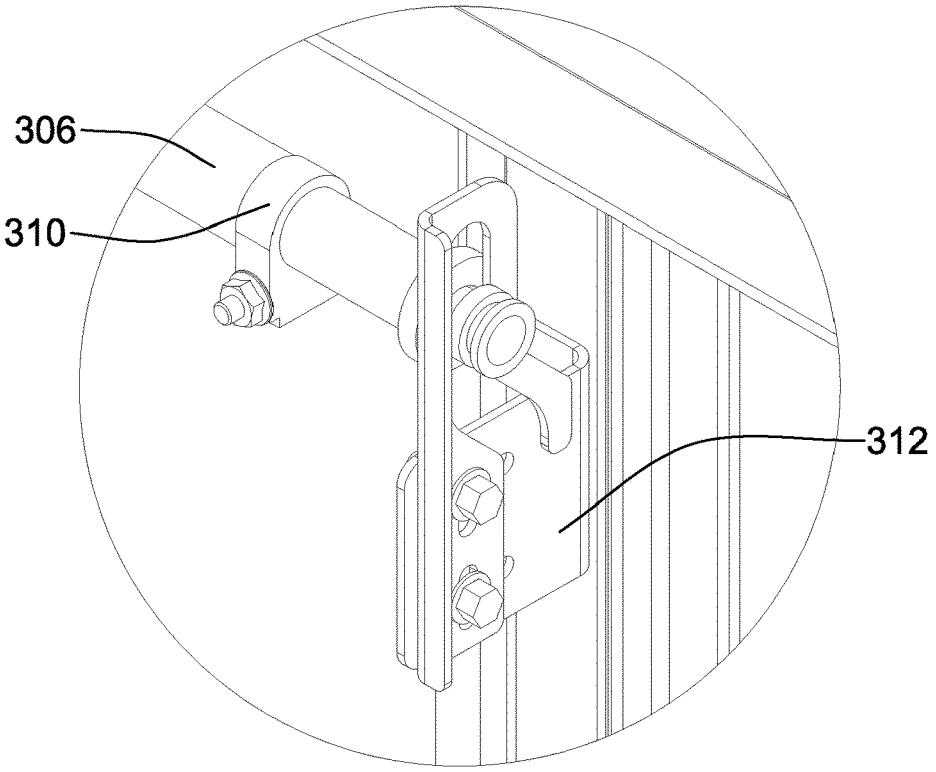
FIG. 3A is an up-close view of the bracket connecting the bulkhead door to the auto-opening bulkhead door actuator.

FIG. 3 illustrates the bulkhead door 106, as viewed from the cargo compartment 104. The bulkhead door 106 is operated by solenoid latch 122 and auto-opening bulkhead door actuator 306. The auto-opening bulkhead door actuator 306 is anchored to the cargo compartment 104 by brackets 308, 310 and attached to the bulkhead door 106 by bracket 312 (as shown in FIG. 3A). When the solenoid latch 122 is released the auto-opening bulkhead door actuator 306 pulls the bulkhead door 106 open. The solenoid latch 122 is released in one embodiment when the operator depresses button 114 on transmitter 112 (see FIG. 1) for a predetermined period, e.g., over one-half second, as opposed to briefly pressing once to activate the ignition control module 120 in an embodiment that provides such operation.

Figure 4:
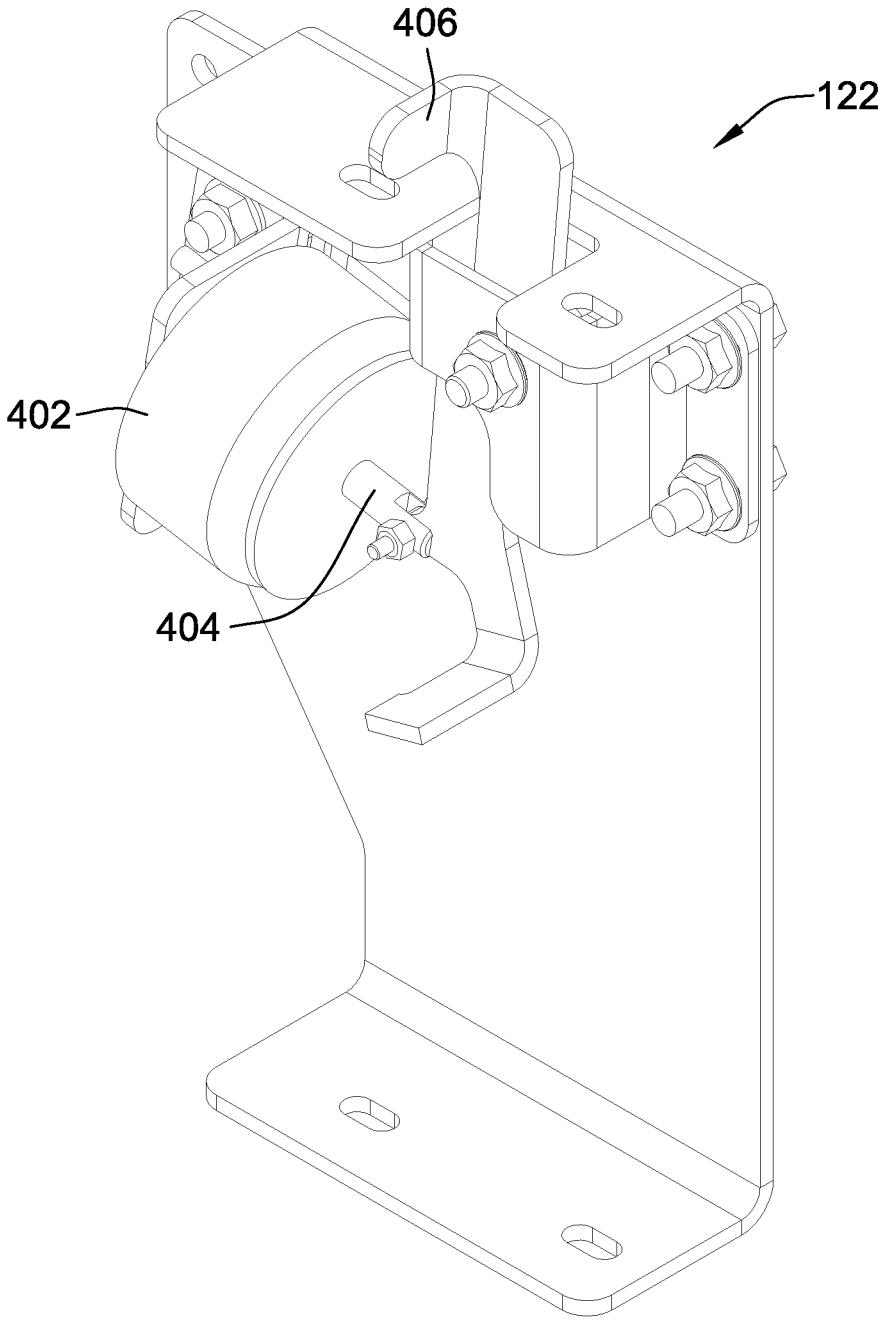
FIG. 4 is an up-close view of the solenoid latch of the bulkhead door.

FIG. 4 illustrates an up-close view of the solenoid latch 122. The solenoid 402 is connected via the solenoid connector arm 404 to lever 406. Solenoid latch 122 operates by a control signal being provided to solenoid 402 from control module 110 of FIG. 1, which actuates the solenoid connector arm 404 to pull the lever 406 thereby unlatching the bulkhead door 106.

Figure 5:
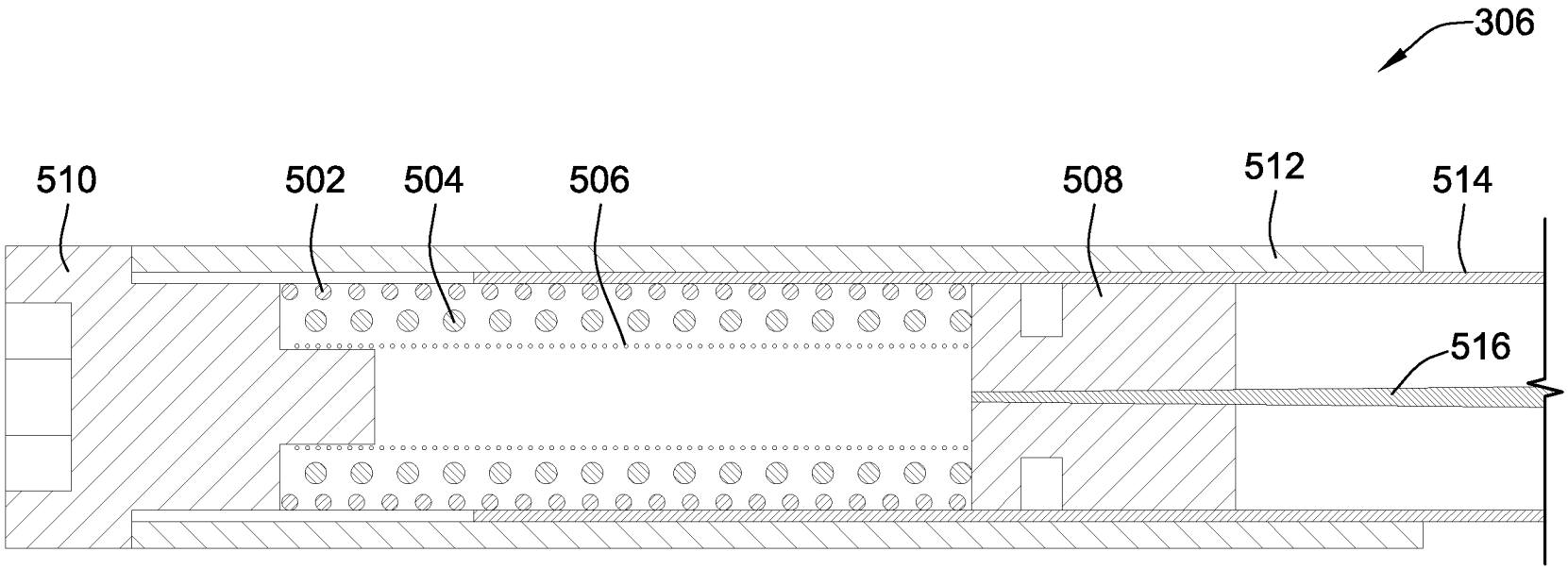
FIG. 5 is a cross section of the auto-opening bulkhead door actuator.

FIG. 5 illustrates a cross-sectional view of an embodiment of the auto-opening bulkhead door actuator 306. While this particular embodiment of the invention illustrates using springs in the auto-opening bulkhead door actuator 306 other methods of opening the bulkhead door 106 are contemplated. Some of the other methods contemplated are electric motor controlled openers, and any hydraulic openers or pneumatic openers, or any equivalent thereof.

Additionally, in the embodiments of the invention discussed herein, the objective of the auto-opening bulkhead door actuator 306 is to open the bulkhead door quickly enough that the operator does not have to wait to enter the cargo compartment. Further, not only must the bulkhead door 106 open quickly, but it must open fully so that the operator has an appropriate amount of room to easily move into and out of the cargo compartment. Even further, it is not enough that the bulkhead door 106 open quickly and fully, but it must also open safely in that it should not cause undue damage to the commercial vehicle 100 or the auto-opening bulkhead door actuator 306 in the process of opening.

Returning to FIG. 5, three springs are contained inside of an inner sheath 514 and an outer sheath 512. The outer sheath is attached to the cargo compartment by bracket 308 and bracket 310, while the inner sheath 514 connects to the bulkhead door via bracket 312. (See FIGS. 3 and 3A). Therefore, the inner sheath 514 is capable of moving and the outer sheath 512 is stationary when installed in the illustrated embodiment.

The inner retracting spring 506 is a resilient member that pulls the bulkhead door 106 open when solenoid latch 122 is actuated. The outer dampening spring 502 and inner dampening spring 504 dampen the retracting force of the inner retracting spring 506. The dampening is necessary to eliminate or limit damage to either the commercial vehicle 100 or the auto-opening bulkhead door actuator 306.

Specifically, slideable member 508, which is inside of the inner sheath 514, is connected to the inner retracting spring 506 and bracket 312 (from FIG. 3A) by the connecting member 516. Therefore, when the bulkhead door is closed the inner retracting spring 506 is stressed such that when solenoid latch 122 is actuated the inner retracting spring 506 retracts pulling the inner sheath 514, the slideable member 508, and the bulkhead door 106 itself open.

In a particular embodiment of the present invention single stage dampening is used for the auto-opening bulkhead actuator 306. Single stage dampening occurs when just before the bulkhead door 106 slides completely open, the slideable member 508 makes contact with both the outer and inner dampening springs 502, 504. The outer and inner dampening springs 502, 504 dampen the force from the bulkhead door 106 opening so not to damage the auto-opening bulkhead door actuator 306 and/or the commercial vehicle 100, but still allowing the door to open quickly and fully.

Another embodiment of the present invention uses dual stage dampening. Dual stage dampening occurs when one spring, either the inner or outer dampening spring 504, 502 makes contact with the slideable member 508 prior to the other. As an example, the outer dampening spring 502 engages the slideable member 508 prior to the inner dampening spring 504. The outer dampening spring 502 is configured such that the opening speed of the bulkhead door 106 is largely decreased just prior to the bulkhead door 106 being entirely opened. And just prior to the bulkhead door 106 being entirely opened the inner dampening spring 504 engages to completely halt the rate at which the bulkhead door 106 is opening. The outer and inner dampening springs 502, 504 allow for the bulkhead door 106 to open quickly, fully, and minimize damage to the commercial vehicle 100 and/or the auto-opening bulkhead actuator 306 that would normally be caused from the bulkhead door 106 slamming open.

Figure 5A:
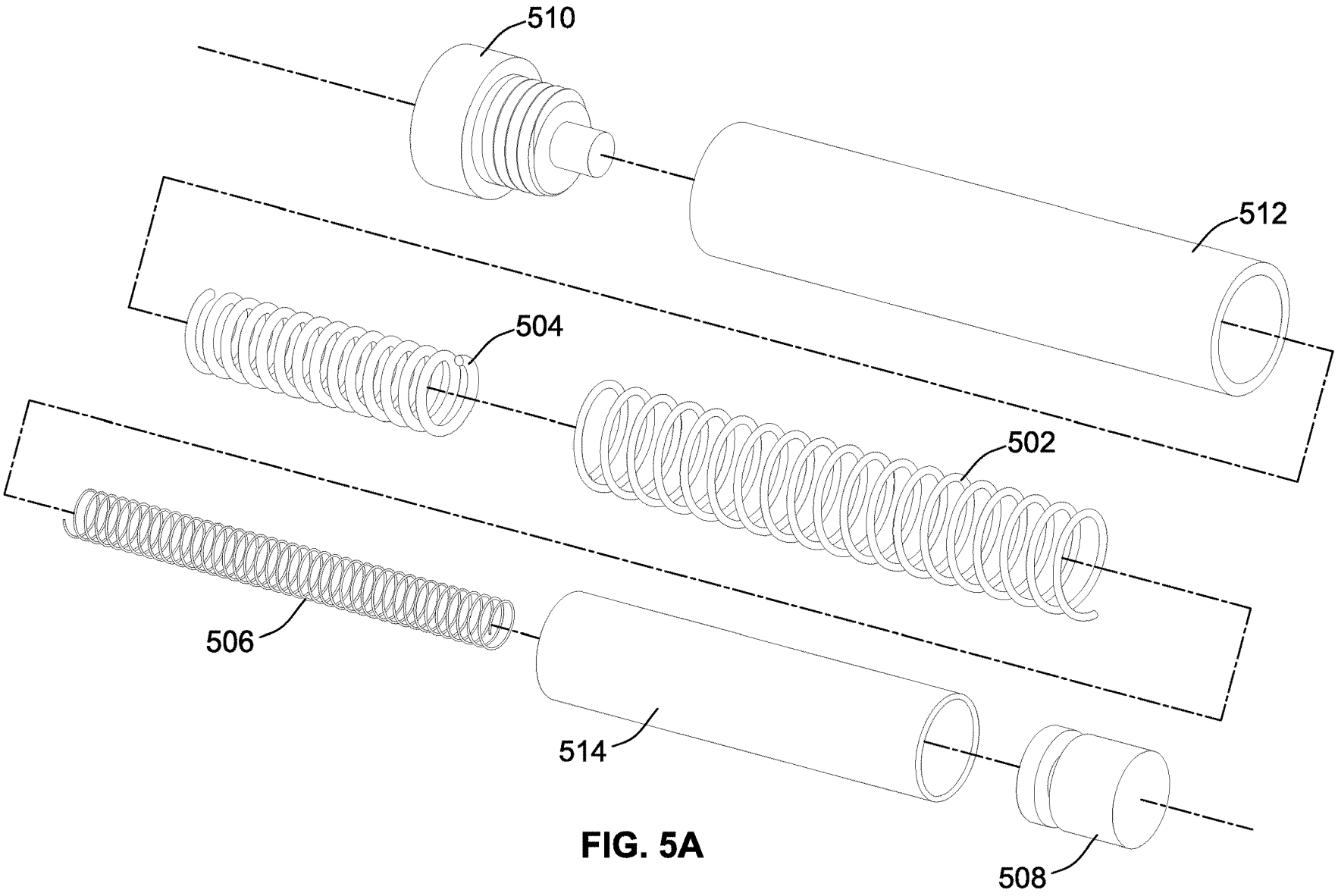
FIG. 5A is an exploded view of the auto-opening bulkhead door actuator.

FIG. 5A shows an exploded view of the auto-opening bulkhead door actuator 306. Notice how the longest resilient member is the inner retracting spring 506, the next longest is the outer dampening spring 502, and the shortest is the inner dampening spring 504. Also, the inner retracting spring 506 the inner dampening spring 504, and the outer dampening spring 502 all are contained within the inner sheath 514, which has a smaller diameter than the outer sheath 512. Both sides of the auto-opening bulkhead door actuator 306 are contained by the base plug 510 on one end and the slideable member 508 on the other.

Figure 6:
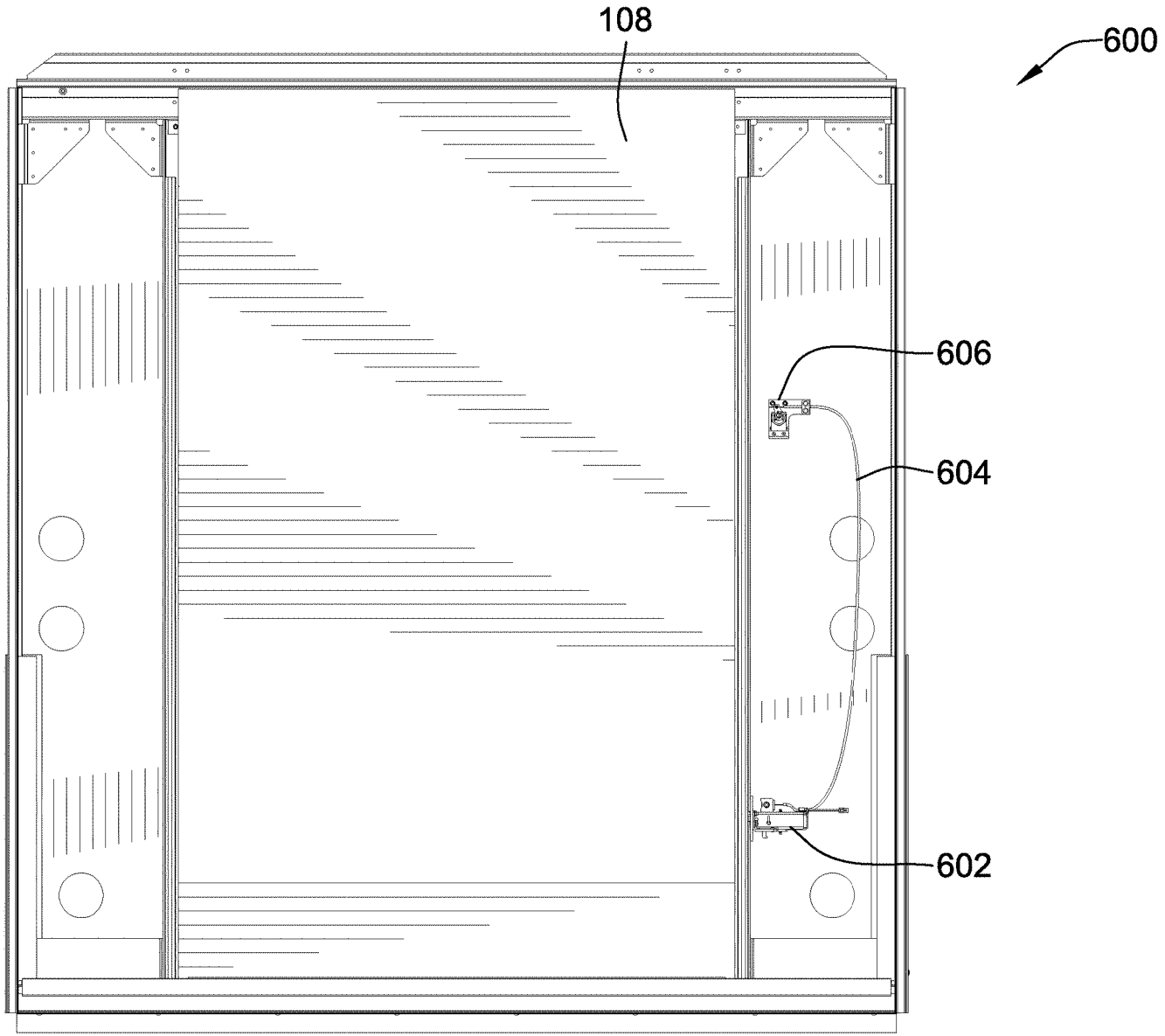
FIG. 6 is a view of the rear door, as viewed from the cargo compartment of the vehicle.

FIG. 6 illustrates the rear door assembly 600. In this embodiment of the invention, the rear door assembly 600 is composed of a roll-up rear door 108, solenoid latch 602, cable 604, and manual cam lock 606.

The solenoid latch 602 is communicatively coupled to control module 110 such that when the operator quickly presses button 114 of transmitter 112 twice the solenoid latch 602 actuates and allows the rear door 108 to slide up. FIG. 6 also displays a manual cam lock 606, which causes the solenoid latch 602 to actuate when the operator rotates the manual cam lock 606 by inserting a key and turning. The turning motion in cam lock 606 causes cable 604 to actuate the solenoid latch 602.

Figure 7:
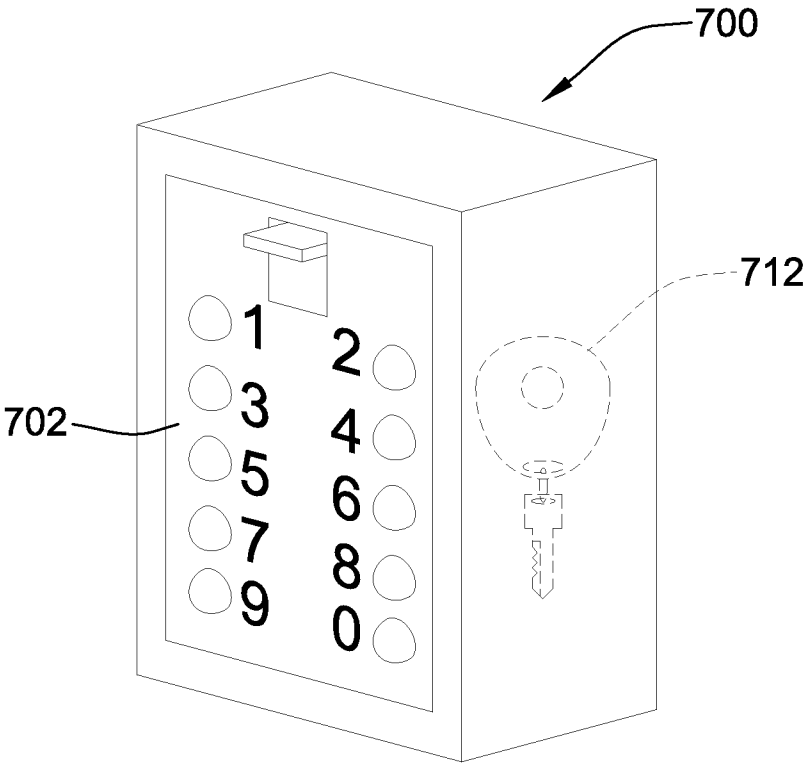
FIG. 7 is an illustration of a lock box used in accordance with an embodiment of the present invention.

FIG. 7 illustrates a particular embodiment of the invention that includes a lock box 700. The lock box 700 is attached to the commercial vehicle 100 and contains a second transmitter 712 in case the first transmitter 112 is lost. The lock box 700 is opened via a locking device 702. FIG. 7 displays a push-button locking device; however, other locking devices such as latch and key devices are contemplated as well.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A keyless access system for a commercial vehicle having a cab compartment, a cargo compartment, a slideable bulkhead door, and a bulkhead wall separating the cab compartment from the cargo compartment, comprising:

an auto-opening bulkhead door actuator attached to the bulkhead wall and to the slideable bulkhead door;

a solenoid latch configured to attach to the bulkhead wall, the solenoid latch operable selectively to latch the bulkhead door in a closed position and to unlatch the bulkhead door to allow opening thereof;

a control module operably coupled to the solenoid latch to control operation thereof; and a transmitter configured to relay an operator command to the control module to open the bulkhead door, wherein the transmitter comprises an ignition control module with a stop button configured to communicate with an ignition system of the commercial vehicle to: (i) turn off an engine thereof upon a first selection of the stop button; and (ii) relay the operator command to the control module to open the bulkhead door upon a second selection of the stop button, wherein the control module is to reset upon a predetermined time period from the first selection of the stop button to prevent opening the bulkhead door upon the second selection of the stop button after the predetermined time period has passed.

2. The system of claim 1, wherein the transmitter comprises a wireless transmitter.

3. The system of claim 1, wherein the ignition control module is configured to relay the operator command to the control module to open the bulkhead door upon the second selection of the stop button within a predetermined period of time from the first selection.

4. The system of claim 3, wherein the ignition control module is configured not to relay the operator command to the control module to open the bulkhead door upon a second selection of the stop button after a predetermined period of time from the first selection.

5. The system of claim 1, wherein the ignition control module includes a start button, and wherein the ignition control module is configured to communicate with the ignition system of the commercial vehicle to turn on the engine thereof upon a selection of the start button.

6. The system of claim 1, wherein the transmitter further comprises a wireless transmitter having at least one user selectable button thereon, and wherein operation of the ignition control module is enabled upon user selection of the button on the wireless transmitter.

7. The system of claim 1, wherein the solenoid latch comprises an electrical solenoid, a lever configured to hold the bulkhead door in a closed position, and a solenoid connector arm coupled between the solenoid and the lever and configured to move the lever to unlatch the bulkhead door upon operation of the solenoid.

8. The system of claim 1, wherein the commercial vehicle includes a rear door assembly configured to alternatively allow or prevent access to the cargo compartment from a rear thereof, further comprising: a rear door solenoid latch operable selectively to latch the rear door in a closed position and to unlatch the rear door to allow opening thereof; wherein the control module is further operably coupled to the rear door solenoid latch to control operation thereof; and wherein the transmitter is further configured to relay a rear door open operator command to the control module to open the rear door.

9. The system of claim 8, further comprising a manual cam lock coupled to the rear door solenoid latch to allow manual unlatching of the rear door.

10. The system of claim 1, further comprising a lock box configured to attach to the commercial vehicle and to hold a second transmitter, the lock box including a locking device to prevent unauthorized access to the second transmitter.

11. The system of claim 1, wherein the control module is configured to receive power from a vehicle power supply, and to couple to an ignition system of the commercial vehicle to control operation of an engine of the commercial vehicle.

12. A keyless access system for a commercial vehicle having a bulkhead door separating a cab compartment from a cargo compartment, comprising:

an auto-opening bulkhead door actuator operably coupled to the bulkhead door;

a remotely-actuated latch operable selectively to latch the bulkhead door in a closed position and to unlatch the bulkhead door to allow opening thereof by the auto-opening bulkhead door actuator;

an ignition control module operably coupled to an ignition system of the commercial vehicle and to the remotely-actuated latch;

a wireless transmitter in operative communication with the ignition control module;

wherein the ignition control module is configured to disable the ignition system to turn off an engine of the commercial vehicle upon a first user input when the engine is running;

wherein the ignition control module is configured to command actuation of the remotely-actuated latch to open the bulkhead door upon a second user input after the first user input, wherein the ignition control module is to reset upon a predetermined time period from the first user input to prevent opening the bulkhead door upon the second user input after the predetermined time period has passed;

wherein the ignition control module is configured to enable the ignition system of the commercial vehicle to turn on the engine thereof upon a third user selection; and wherein operation of the ignition control module to enable the ignition system of the commercial vehicle to turn on the engine thereof upon the third user selection is enabled upon a user selection of the wireless transmitter.

13. The system of claim 12, wherein the ignition control module is configured to command actuation of the remotely-actuated latch to open the bulkhead door upon sustained user input for more than a predetermined time.

14. The system of claim 12, further comprising a lock box configured to attach to the commercial vehicle and to hold a second transmitter, the lock box including a locking device to prevent unauthorized access to the second transmitter.

* * * * *